US005634519A

United States Patent [19]

Laveran

[11] Patent Number: 5,634,519

[45] Date of Patent: Jun. 3, 1997

[54] HEAT EXCHANGER, ESPECIALLY FOR COOLING A HIGH TEMPERATURE AIR STREAM

[75] Inventor: Jean-Louis Laveran, Asnieres Sur Seine, France

[73] Assignee: Valeo Thermique Moteur, Le Mesnil-Saint-Denis, France

[21] Appl. No.: 478,284

[22] Filed: Jun. 7, 1995

[30] Foreign Application Priority Data

Jun. 8, 1994 [FR] France ..... 94 07026

[51] Int. Cl.[6] ..... F28D 1/02

[52] U.S. Cl. ..... 165/153; 165/175; 165/173; 29/890.052

[58] Field of Search ..... 165/153, 173, 165/175, 76; 29/890.052

[56] References Cited

U.S. PATENT DOCUMENTS

| | | | |
|---|---|---|---|
| 1,731,575 | 10/1929 | Hyde | 165/175 |
| 1,736,906 | 11/1929 | Flintermann | 165/175 |
| 3,650,321 | 3/1972 | Kaltz | 165/175 X |
| 4,011,905 | 3/1977 | Millard | 165/153 X |
| 4,258,785 | 3/1981 | Beldam | 165/175 |
| 4,846,268 | 7/1989 | Beldam et al. | 165/153 |
| 4,938,284 | 7/1990 | Howells | 165/175 X |
| 5,046,555 | 9/1991 | Nguyen | 165/173 |
| 5,086,832 | 2/1992 | Kadle et al. | 165/76 |
| 5,125,452 | 6/1992 | Yamauchi et al. | 165/153 X |
| 5,176,205 | 1/1993 | Anthony | 165/153 |

FOREIGN PATENT DOCUMENTS

| | | | |
|---|---|---|---|
| 0324226 | 7/1989 | European Pat. Off. . | |
| 1448155 | 6/1965 | France | 165/153 |
| 2194933 | 3/1974 | France . | |
| 2337867 | 1/1976 | France . | |
| 2563899 | 2/1985 | France . | |
| 3500571 | 11/1985 | Germany | 165/153 |
| 4363592 | 12/1992 | Japan | 165/173 |

OTHER PUBLICATIONS

French Search Report Mar. 3, 1995.

*Primary Examiner*—John Rivell
*Assistant Examiner*—Christopher Atkinson
*Attorney, Agent, or Firm*—Morgan & Finnegan, LLP

[57] ABSTRACT

A heat exchanger comprises a bundle of tubes mounted between two fluid headers, each of which comprises a stack of shell members fitted together in pairs. Each shell member has a closed side wall which is joined to a flat outer flange and a flat inner flange. The inner flange defines an axial aperture, while the side wall of each shell member defines a lateral aperture having a cross section matching one half of the transverse cross section of a tube of the bundle. The shell members are assembled in pairs so as to define an internal chamber extending over the whole height of the stack, with each tube end being received in an aperture consisting of the two side apertures, joined together, of two adjacent shell members. The heat exchanger of the invention is applicable for example to the cooling of a high temperature air stream from a vehicle turbo charger.

9 Claims, 5 Drawing Sheets

HEAT EXCHANGER, ESPECIALLY FOR COOLING A HIGH TEMPERATURE AIR STREAM

FIELD OF THE INVENTION

This invention relates to a heat exchanger of the type comprising a bundle of tubes mounted between two fluid headers. It is especially directed, though without limitation, to a heat exchanger suitable for use in the cooling of a high temperature air stream.

BACKGROUND OF THE INVENTION

Numerous heat exchangers of this type are already known, in which a first fluid, which is usually water, flows into one of the headers, after which it passes through the tubes of the bundle so as to reach the other header and eventually leave the heat exchanger, after having undergone heat transfer with another fluid, which is commonly an air stream directed over the tubes of the bundle. Such heat exchangers are mainly used as air/water heat exchangers: they find many varied applications in the automotive industry, especially for engine cooling purposes or for supplying heated air to the cabin of the vehicle.

However, heat exchangers of this type have not in the past been able to be used, having regard to the high temperatures employed, for the treatment of a high temperature air stream, for example in cooling of an air stream produced by the turbo compressor of an automotive or industrial vehicle. In this connection, the air stream delivered from a turbo compressor has a high temperature which is generally of the order of 250° C., which has to be reduced to a temperature of the order of 100° C. by heat transfer with the cooling water or cooling air.

In this particular application to cooling of the air stream delivered from a turbo compressor, a particular type of heat exchanger has been used up to the present time. This comprises two fluid headers, a multiplicity of spacing bars arranged in pairs, and a multiplicity of plates which are arranged in pairs so as to enclose the pairs of bars and to define, with the latter, fluid flow channels. One heat exchanger of this type is known in particular from the specification of French patent No. 80 06704, published under the number 2 479 438.

The main disadvantage of this type of heat exchanger lies in the complexity of the assembly of its various components.

DISCUSSION OF THE INVENTION

A main object of the invention is to overcome this drawback.

Another object is to provide a heat exchanger of the type having headers and a tube bundle which is able to be used in different applications, and in particular, that of treating a stream of high temperature air such as the air stream delivered from a turbo compressor.

A further object of the invention is to provide a heat exchanger of the above type which is easy to assemble, in particular by brazing.

According to the invention, a heat exchanger comprising a bundle of tubes fitted between two fluid headers is characterised in that each fluid header comprises a stack of shell members arranged in pairs, in which each shell member has a closed side wall, one end of which is joined to a flat outer flange, with its other end being joined to a flat inner flange which extends parallel to the flat outer flange and which has an axial through aperture, and in which the side wall of each shell member defines a lateral aperture the cross section of which matches one half of the transverse cross section of a tube of the heat exchanger, so that the shell members are able to be assembled in pairs, alternately through their inner flanges and their outer flanges, thereby defining an internal chamber over the whole length of the stack, with each tube end being received in the aperture formed by two lateral apertures of two adjacent shell members.

In this way, each of the headers is constituted by a stack of shell members, that is to say basin-shaped elements, which can be assembled in pairs and which can also be fitted to the ends of the tubes in the bundle.

Such a heat exchanger can easily be made by brazing the shell members and tubes together, the shell members and the said tubes being made of an appropriate metal alloy.

A heat exchanger of this type is most particularly suitable for the cooling of supercharging air from a turbo compressor, and in that case the supercharging air flows into one of the header chambers, after which it passes through the tubes in the bundle before reaching and then leaving the other header chamber.

Preferably, the high temperature supercharging air is cooled by an air stream which is passed over the outside of the tubes of the bundle.

Preferably, the lateral aperture of a shell member is delimited by an offset region of the inner flange of the shell member, which region is closer to the plane of the outer flange than is the plane of the inner flange.

According to a preferred feature of the invention, each of the tubes has a transverse cross section which is substantially rectangular, being delimited by two major sides and two minor sides, the offset region of the inner flange comprising a central portion having a length substantially equal to a major side, together with two lateral portions having a length substantially equal to one half of a minor side. Thus, when two shell members are fitted together through their respective inner flanges, their two lateral apertures define a complete aperture having a cross section matching the transverse cross section of a tube.

According to another preferred feature of the invention, the offset region of the inner flange is joined to a substantially straight region of the side wall of the shell member.

Preferably, the side wall of each shell member further includes a substantially semicircular region joined to the straight region.

According to a further preferred feature of the invention, the side wall of each shell member has a drawn form which is flared from the flat inner flange towards the flat outer flange. This particular structure facilitates the manufacture of the shell member by stamping or punching using an appropriate drawing tool.

According to yet another preferred feature of the invention, the outer flange of each shell member includes indexing means for positioning the two shell members of any one pair correctly with respect to each other, for their assembly through their respective outer flanges.

These indexing means may take various forms. By way of example, the indexing means of one shell member may comprise two bent-back lugs, each of which is formed in an aperture in the outer flange, these lugs being arranged to be introduced into a corresponding aperture in another shell member. These lugs may have the function of indexing lugs and/or of seaming lugs.

Preferably, the outer flange of each shell member has at least one seaming lug formed at its periphery, the lug being adapted to be bent back for assembly of the two shell members of any one pair.

The heat exchanger of the invention preferably includes dissipators or corrugated spacers disposed on either side of the tubes in the bundle.

According to yet another preferred feature of the invention, the heat exchanger further includes an end plate which extends parallel to the tubes in the bundle, and which is assembled to the two endmost shell members situated at a first end of each header, with the end plate being provided with two pipes which serve, respectively, for the admission and evacuation of a fluid flowing through the headers and the tubes of the bundle, while the two shell members situated at a second end of each header are closed.

These last mentioned shell members are either closed by means of a common second end plate, or else they consist of special shell members having a continuous base at the level of, and replacing, the flat inner flange.

The description of preferred embodiments of the invention which follows, is given by way of example only and with reference to the accompanying drawings.

DESCRIPTION OF PREFERRED EMBODIMENTS OF THE INVENTION

Figure 1:
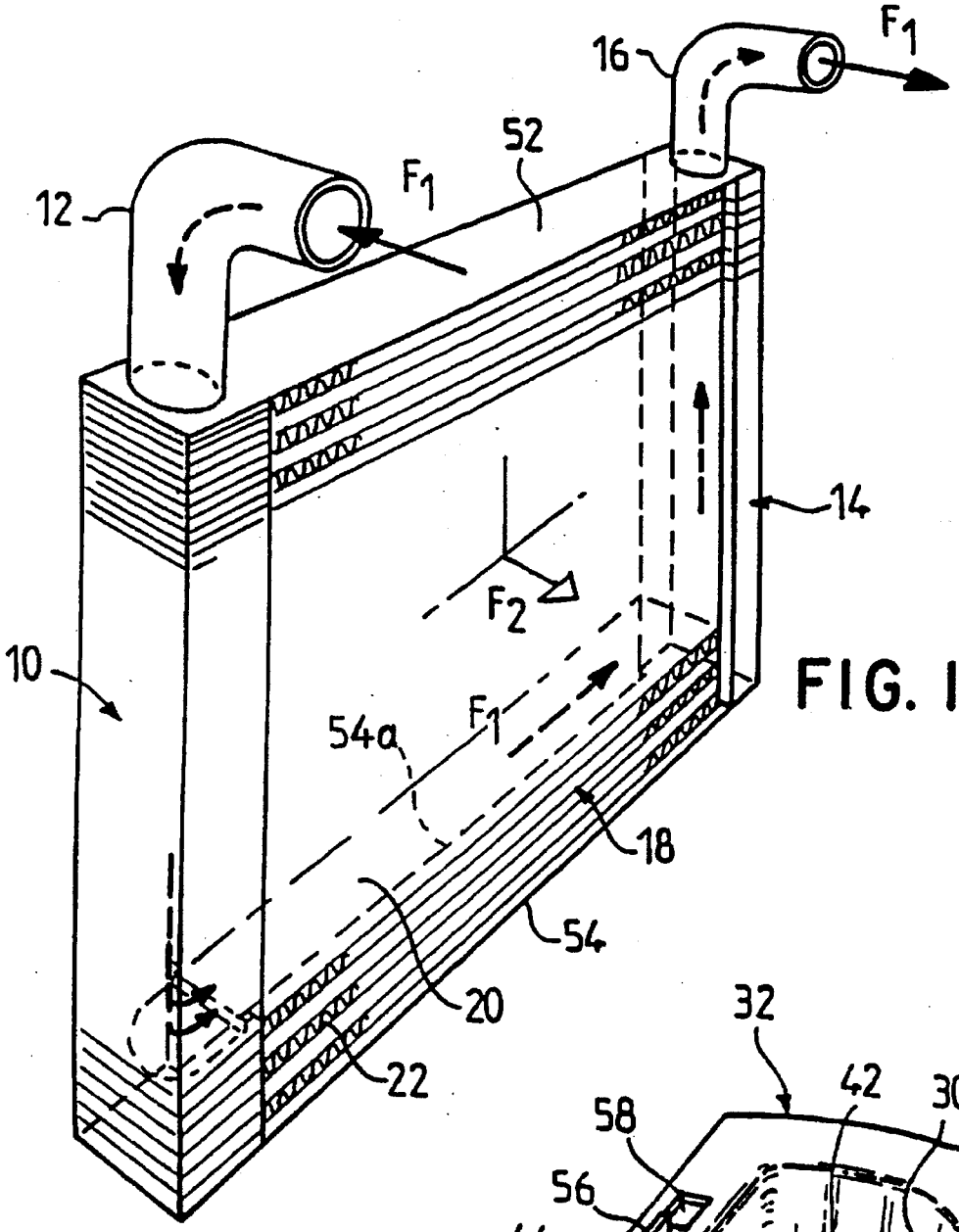
FIG. 1 is a perspective view of one heat exchanger in accordance with the invention.

The heat exchanger shown in FIG. 1 comprises a fluid header 10 connected to an admission pipe 12, a fluid header 14 connected to an evacuation pipe 16, and a tube bundle 18 which is fitted between the two headers 10 and 14.

The tube bundle 18 consists of a multiplicity of parallel tubes 20 of rectangular cross section, the respective ends of which are open into the two headers 10 and 14. In addition, the tube bundle includes heat dissipators or fins 22, arranged between the tubes 20 and being in the form of corrugated webs acting as spacers between the tubes.

The heat exchanger is arranged for a first fluid to pass through it. This first fluid is for example supercharging air delivered from a turbo compressor, and it enters the first header 10 via the admission pipe 12, after which it passes through the tubes 20 so as to reach the second header 14, which it leaves via the evacuation pipe 16 as shown by the arrows F1 in FIG. 1. This first fluid exchanges heat with a second fluid which flows over the tube bundle 18 in the manner indicated by the arrow F2.

Figure 2:
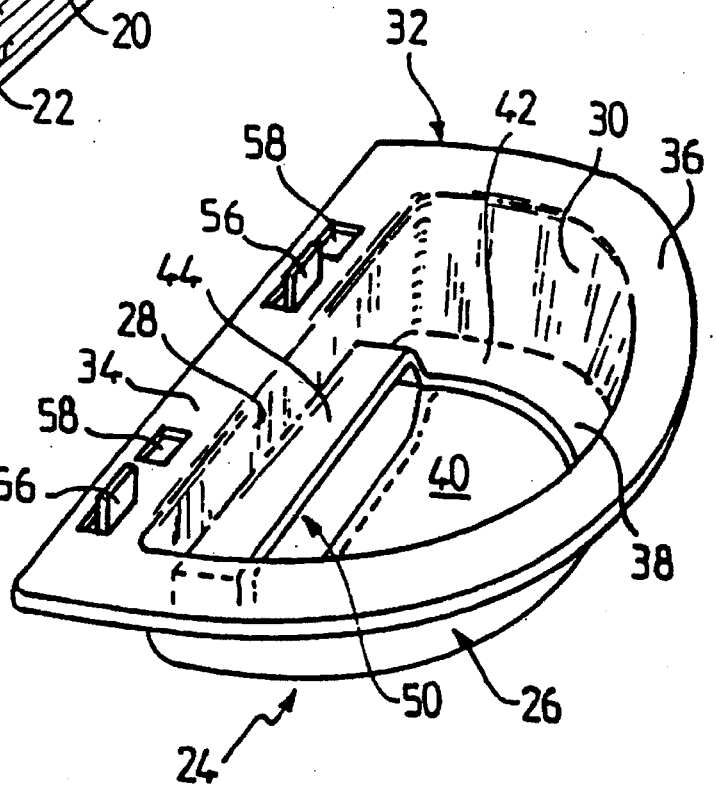
FIG. 2 is a perspective view of a shell member in a first embodiment of the invention.
Figure 3:
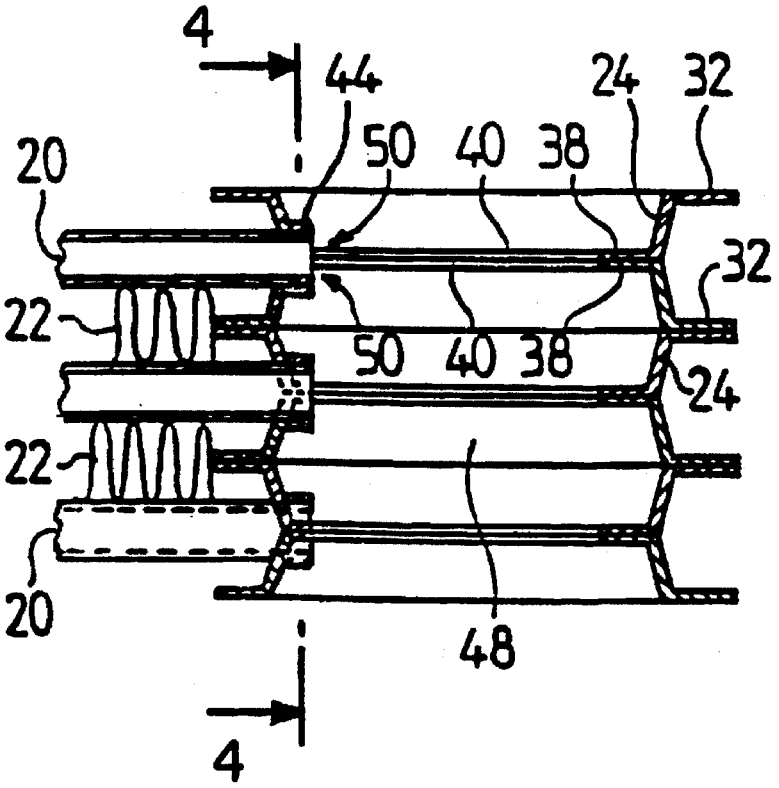
FIG. 3 is a partial view in longitudinal cross section of a heat exchanger having shell members in accordance with FIG. 2.
Figure 4:
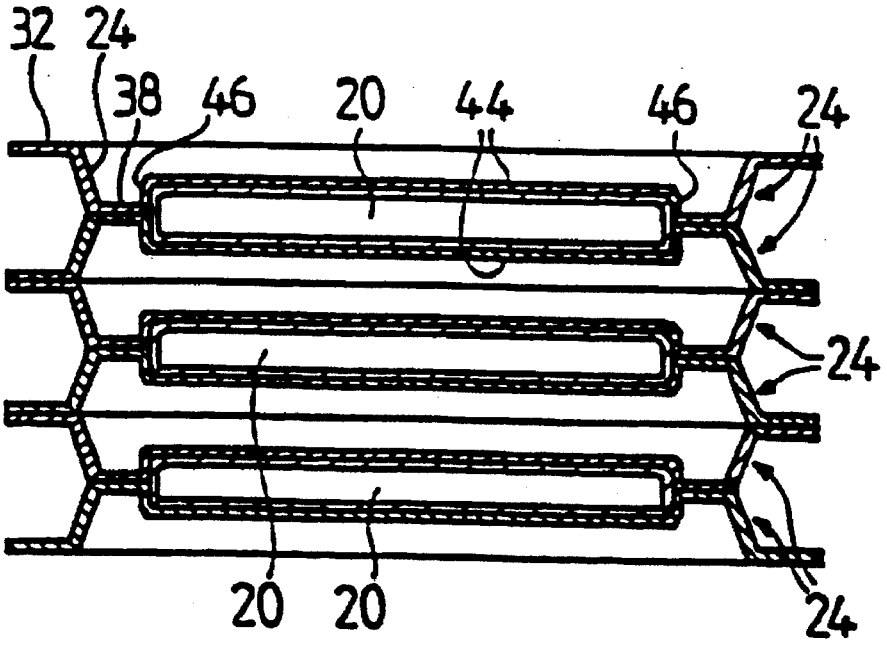
FIG. 4 is a view in cross section taken on the line IV—IV in FIG. 3.

Each of the headers 10 and 14 is in the form of a stack of identical shell members, which are arranged in alternating pairs as shown in FIGS. 3 and 4. One of these shell members is shown in perspective in FIG. 2, to which reference is now made. The shell member 24 is formed by stamping or punching from a metallic flat blank, preferably of stainless steel. The shell member 24 has a closed side wall 26, having a region 28 which is substantially straight and which is joined to a substantially semicircular region 30 of the wall 26.

At its upper end (FIG. 2), the wall 26 is joined to a flat outer flange 32 which has a substantially straight portion 34 joined to the straight region 28 of the side wall 26. The flange 32 is completed by a substantially semicircular portion 36, which is joined to the semicircular region 30 of the side wall 26. The flange 32 extends radially outwardly from the side wall 26.

At its lower end (FIG. 2), the side wall 26 is joined to a flat inner flange 38 which extends parallel to the flat outer flange 32 and which bounds an axial aperture 40, which is substantially semicircular in shape. The inner flange 38 extends radially inwardly from the side wall 26. As can be seen in FIGS. 2 to 4, the side wall 26 is formed by drawing in such a way as to be flared from the flat inner flange 38 towards the flat outer flange 32.

As can again be seen in FIG. 2, the flat inner flange 38 includes a substantially semicircular portion 42 extending in the general plane of the flange 38 and joined to the semicircular region 30 of the side wall 26. This portion 32 is joined to an offset region which is also part of the inner flange 38, and which lies closer to the plane of the outer flange 32 than is the plane of the semicircular portion 42 of the inner flange. This offset region comprises a central portion 44 (see FIGS. 2 to 4), which extends parallel to the plane of the two flanges 32 and 38, together with two side portions 46 which join the central portion 44 to the semicircular portion 42 of the flange.

As is best seen in FIGS. 3 and 4, to which reference is now made, the shell members 24 are arranged to be stacked and assembled in pairs, in alternate orientations, being in contact through their inner flanges 38 and their outer flanges 32. This arrangement defines an internal chamber 48 (FIG. 3) which extends over the whole height of the stack.

When two shell members 24 are joined through their respective inner flanges 38, their offset regions define, respectively, two lateral apertures 50 (FIG. 2) for receiving the end of a tube 20 of the bundle 18. In this example, the tubes 20 have a straight cross section which is substantially rectangular and which is defined by two major sides and two minor sides. The central portion 44 of the offset region has a length which is substantially equal to one of these major sides, while the two side portions 46 have a length which is substantially equal to one half of a minor side of the rectangle. In other words, the central portion 44 and the two side portions 46 in any one shell member 24 define a lateral aperture which corresponds substantially to one half of the lateral cross section of a tube.

The bundle 18 which consists of the tubes 20 and the dissipators 22 is mounted between the headers 10 and 14, each of which is constituted by a stack of the shell members 24. The tubes 20 and the dissipators 22 are preferably made from an alloy of stainless steel and aluminium.

After the various components have been fitted and assembled together to form the heat exchanger, these components are preferably secured together by brazing in an oven.

As can be seen in FIG. 1, the heat exchanger has two end plates 52 and 54 which lie, respectively, at the top and at the bottom when the radiator is in the upright position shown in FIG. 1. The top end plate 52 extends parallel to the tubes 20, and is assembled to the two shell members 24 which lie at the upper ends of the headers 10 and 14. This end plate 52 itself carries the two pipes 12 and 16. The lower end plate 54 extends parallel to the tubes 20, and is assembled to the two shell members 24 which lie respectively at the opposite ends of the headers 10 and 14. The lower end plate 54, as illustrated by broken line 54*a* thus closes the aperture 40 of the last shell member in the stack in the header 10 or the header 14.

In a modification (not shown), it would be possible to provide, as the lowest element in each stack, a special shell member having a continuous base in place of the inner flange 38, i.e. not having the aperture 40, so closing off the corresponding end of the appropriate header.

As is shown in FIG. 2, the straight portion 34 of the outer flange 32 is formed with two indexing lugs 56, formed by punching and bending, together with two indexing apertures 58 of corresponding form. When two shell members 24 are assembled together through their outer flanges 32, the two indexing lugs 56 of one shell member penetrate into the two apertures 58 of the other shell member and vice versa. This gives correct relative positioning of the two shell members of a pair, with a view to their being subsequently fixed together by brazing.

Figure 5:
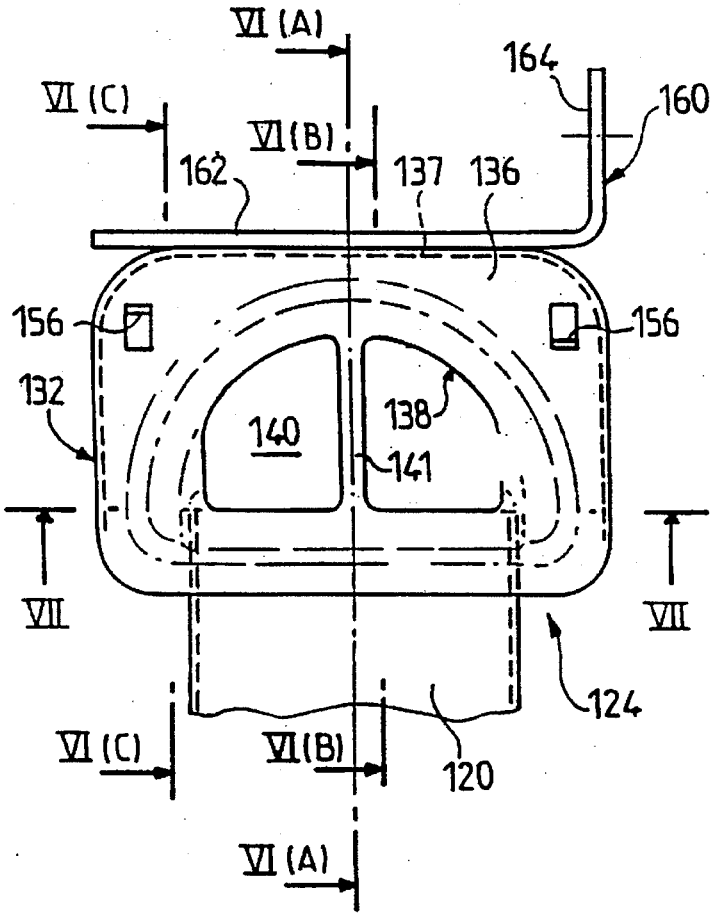
FIG. 5 is a partial view in transverse cross section of a heat exchanger in a second embodiment of the invention.
Figure 6:
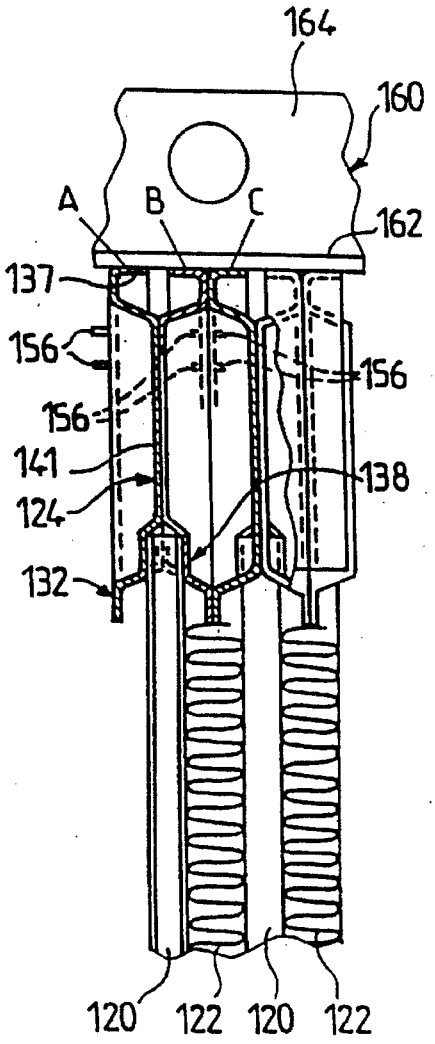
FIG. 6 is a view in cross section taken on the lines VI(A)—VI(A), VI(B)—VI(B) and VI(C)—VI(C) in FIG. 5.
Figure 7:
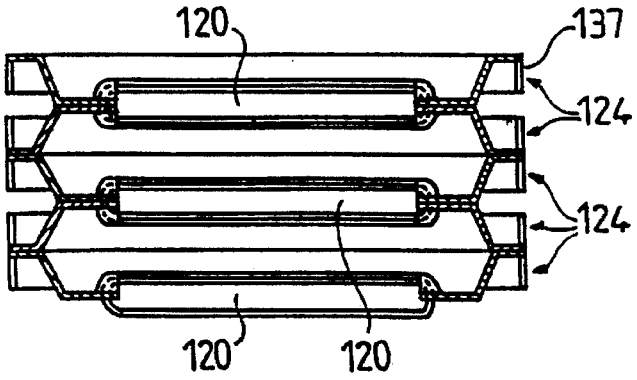
FIG. 7 is a view in cross section taken on the line VII—VII in FIG. 5.

Reference is now made to FIGS. 5 to 7, showing a modified embodiment in which those elements which are common to elements seen in FIGS. 2 to 4 for the first embodiment of the invention are given the same reference numerals increased by 100.

The shell member 124 is similar to the shell member 24 described above. However, it differs from the latter by the fact that the flat outer flange 132 has a substantially rectangular form, with four rounded angles, instead of a substantially semicircular form. The flange 132 has two indexing lugs 156 which are formed in apertures in a region 136 of the flange which lies on the same side as the semicircular region of the side wall (indicated by broken lines in FIG. 5), of the shell member. This region 136 is extended by a bent-back edge portion, or additional flange, 137, which extends in a plane parallel to the stacking direction.

When the shell members are stacked together, the additional flanges 137 define an engagement plane, on which a support plate 160 is fitted. The support plate 160 comprises a spine 162 to which a wing portion 164 is joined at right angles, as shown in FIGS. 5 and 6.

The shell member 124 differs again from the shell member 24 of the first embodiment in that an integral bridge 141 extends radially across the aperture 140.

FIG. 6 is a composite cross sectional view in which the construction of the heat exchanger, in successive vertical portions indicated at A, B and C in FIG. 6 are taken on the section planes VI(A), (B) and (C) respectively in FIG. 5.

Reference is now made to the further embodiment shown in FIGS. 8 and 9, which is a modified version of the embodiment just described with reference to FIGS. 5 to 7. Those elements in FIGS. 8 and 9 which are common to the version in FIGS. 5 and 6 are designated in FIGS. 8 and 9 by the same reference numerals increased by 100. The main difference lies in the fact that the outer flange 232 has, in its region 234, a lug 259 which occupies less than half the width of the shell member. When two shell members are put together through their outer flanges 232, the lugs 256 give indexation, while the two lugs 259 may be bent back as shown in FIG. 9 in order to seam the two shell members 224 together.

Figure 9:
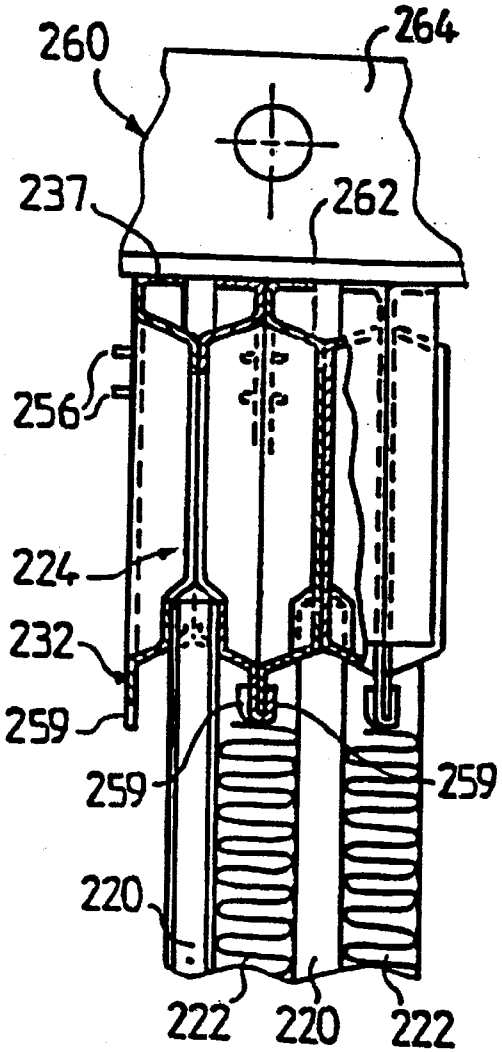
FIG. 9 is a view in cross section taken on the line IX—IX in FIG. 8.
Figure 8:
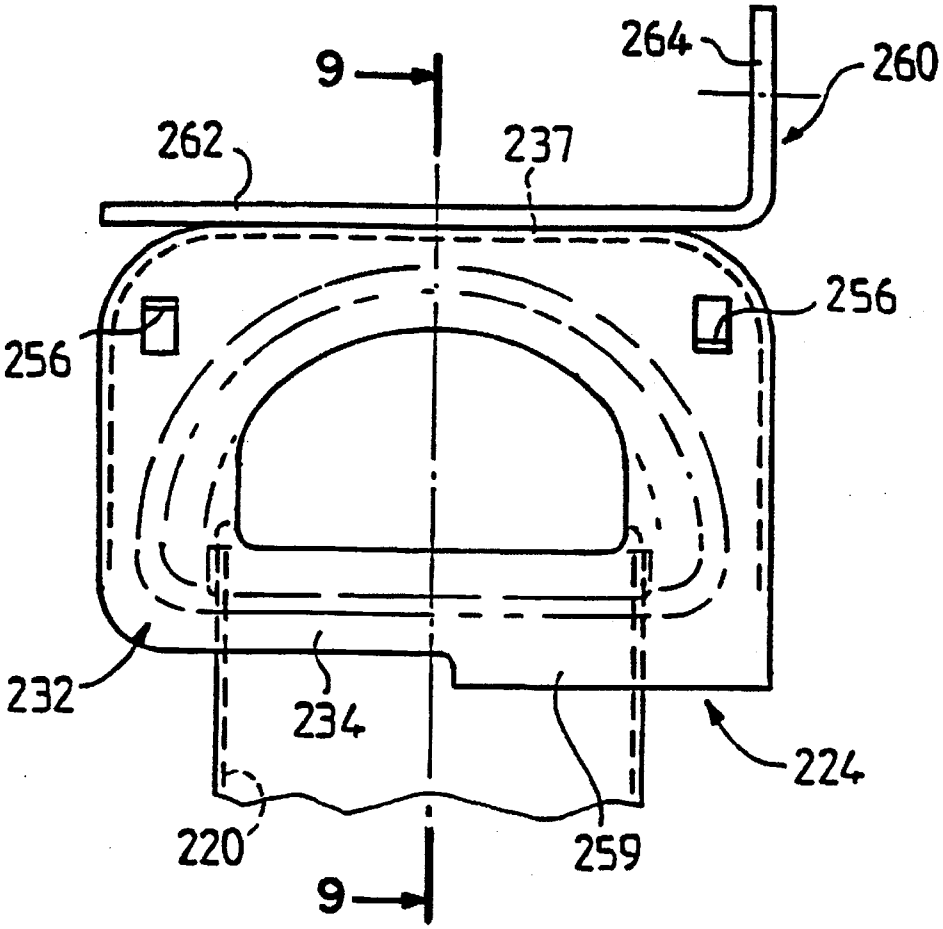
FIG. 8 is a view in transverse cross section showing part of a heat exchanger in a third embodiment of the invention.
Figure 11:
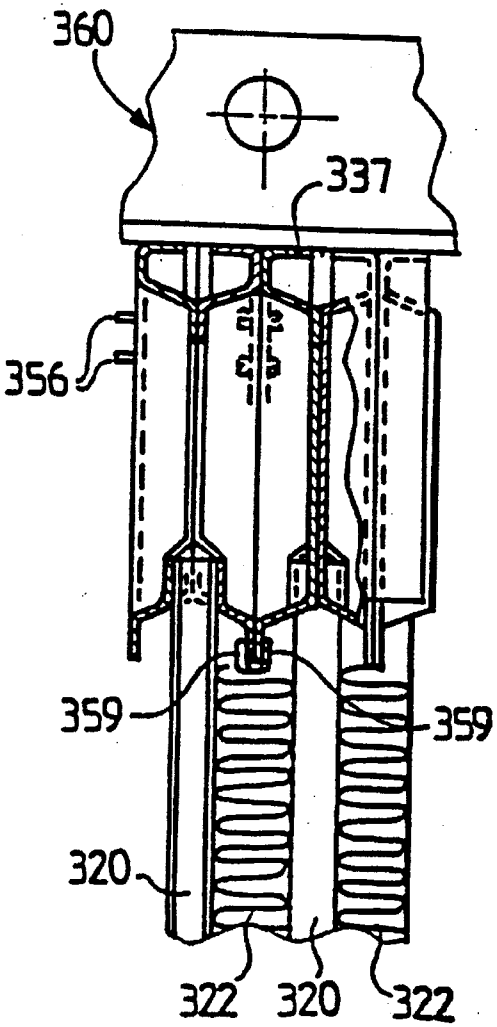
FIG. 11 is a view in cross section taken on the line XI—XI in FIG. 10.
Figure 10:
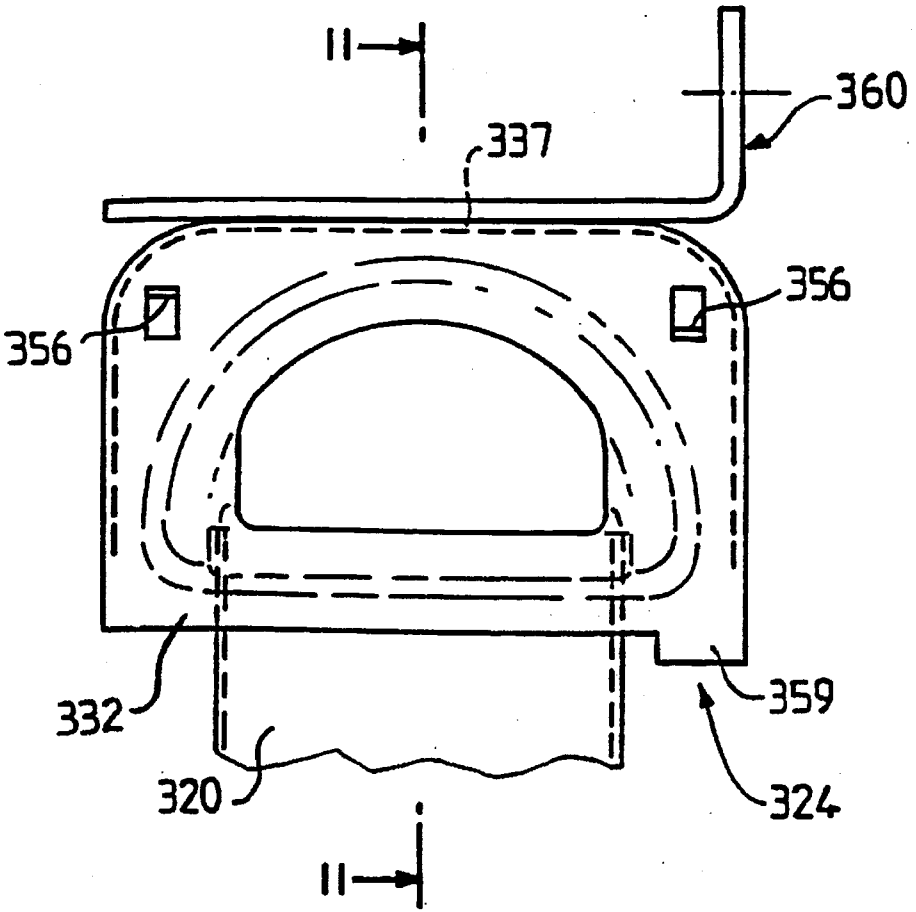
FIG. 10 is a view in transverse cross section showing part of a heat exchanger in a fourth embodiment of the invention.

Reference is now made to the further embodiment shown in FIGS. 10 and 11, which is a modified version of that shown in FIGS. 8 and 9. Those elements in FIGS. 10 and 11 which are common to the version shown in FIGS. 8 and 9 are indicated by the same reference numerals increased by 100. In this version, the main difference lies in the fact that the seaming lug 359 extends over a smaller width. In addition, the indexing lugs 356 also serve as seaming lugs, as can be seen in FIG. 11. After two shell members 324 have been positioned together through their respective outer flanges 332, the indexing lugs 356 are bent back so that they also act as seaming lugs. Similarly, the lugs 359 are bent back to provide seaming.

The invention is of course not limited to the various embodiments described above by way of example. It will be understood that the invention is not limited to a heat exchanger for cooling an air stream by heat exchange with another air stream, and that it may equally well be used to provide heat transfer between other types of fluids.

What is claimed is:

1. A heat exchanger comprising two fluid headers and a bundle of tubes fitted between the headers, each of the tubes having a cross section transverse to the respective tube lengths thereof, wherein each header comprises a stack of shell members arranged in pairs, the stack having a predetermined height, each shell member having an endless side wall, a flat outer flange joined to one edge of the side wall, and a flat inner flange joined to the other edge of the side wall, the inner flange being parallel to the flat outer flange and defining an axial through aperture, the side wall of the shell member defining a lateral aperture having a cross section corresponding to one half of the transverse cross section of the tube, indexing means for positioning the shell members on the flat outer flange of each shell member, said inner flange having an offset region defining said lateral aperture of the shell member, said offset region lying intermediately between the plane of the outer flange and the plane of the inner flange, the sidewall of each shell member including a substantially straight region joined to said offset region of the inner flange, whereby the shell members are assembled in pairs of alternate shell members, through their inner and outer flanges, so as to define together an internal chamber extending over the whole height of stack, the tubes having end portions each of which is received in the two said lateral apertures of two adjacent shell members, the indexing means positioning the shell members of a pair with respect to each other through their respective outer flanges.

2. A heat exchanger according to claim 1, wherein each said tube has a substantially rectangular transverse cross section defining two major sides and two minor sides, the offset region on the inner flange of each shell member, the offset region comprising a central portion having a length substantially equal to one of said major sides, together with two lateral portions, each of which lateral portions has a length substantially equal to one half of one of said minor sides.

3. A heat exchanger according to claim 1, wherein the side wall of each shell member further includes a substantially semicircular region joined to said straight region.

4. A heat exchanger according to claim 1, wherein the side wall of each shell member has a drawn configuration which is flared from the flat inner flange towards the flat outer flange.

5. A heat exchanger according to claim 1, wherein the outer flange of each shell member has two first apertures and two lugs bent back from the respective first apertures and two second apertures, said lugs and said second apertures constituting the indexing means and being so disposed that when two shell members are mounted with their outer flanges together back to back, the indexing lugs of each shell member engage in the second apertures of the other shell member in each of said alternate shell member pairs.

6. A heat exchanger according to claim 1, wherein the outer flange of each shell member defines at least one peripheral seaming lug adapted to be bent back so as to secure together the shell members in each of said alternate shell member pairs.

7. A heat exchanger according to claim 1, further including dissipators arranged on either side of the tubes of the bundle.

8. A heat exchanger according to claim 1, having an end plate parallel to the tubes and assembled to the endmost said shell members of each header at a first end of the latter, an admission pipe carried by said end plate and communicating with a first said header, and an evacuation pipe carried by said end plate and communicating with the other header, whereby a fluid introduced through the admission pipe can flow through the first header and thence through the tubes and the other header to the evacuation pipe, the endmost shell members at the other, second, end of each header being closed.

9. A heat exchanger according to claim 8, wherein the endmost shell members at the second end of each header are closed by means selected from a common second end plate of the heat exchanger, and a continuous base portion of said endmost shell members replacing the flat inner flange thereof.

* * * * *